US007412834B2

(12) United States Patent
Bes et al.

(10) Patent No.: US 7,412,834 B2
(45) Date of Patent: Aug. 19, 2008

(54) ANNULAR COMBUSTION CHAMBER FOR A TURBOMACHINE WITH AN IMPROVED INNER FASTENING FLANGE

(75) Inventors: Martine Bes, Morsang/Orge (FR); Didier Hernandez, Quiers (FR); Gilles Lepretre, Epinay Sous Senart (FR); Denis Trahot, Ermont (FR)

(73) Assignee: SNECMA, Paris (FR)

( * ) Notice: Subject to any disclaimer, the term of this patent is extended or adjusted under 35 U.S.C. 154(b) by 628 days.

(21) Appl. No.: 11/100,543

(22) Filed: Apr. 7, 2005

(65) Prior Publication Data

US 2005/0229606 A1 Oct. 20, 2005

(30) Foreign Application Priority Data

Apr. 15, 2004 (FR) ..... 04 03924

(51) Int. Cl.
*F23R 3/50* (2006.01)
*F02C 7/18* (2006.01)

(52) U.S. Cl. ..... 60/804; 60/752; 60/806

(58) Field of Classification Search ..... 60/796–800, 60/804, 782, 785, 806, 752
See application file for complete search history.

(56) References Cited

U.S. PATENT DOCUMENTS 4,466,239 A * 8/1984 Napoli et al. ..... 60/782
5,279,127 A * 1/1994 Napoli ..... 60/754
5,758,504 A * 6/1998 Abreu et al. ..... 60/800
6,434,821 B1 8/2002 Nelson et al.

FOREIGN PATENT DOCUMENTS

FR 2 356 000 1/1978

* cited by examiner

*Primary Examiner*—Ted Kim
(74) *Attorney, Agent, or Firm*—Oblon, Spivak, McClelland, Maier & Neustadt, P.C.

(57) ABSTRACT

An annular combustion chamber for a turbomachine comprises inner and outer annular walls united by a transverse wall, the inner and outer walls are extended at their downstream ends by inner and outer fastener flanges for fastening respectively to inner and outer shells of a turbomachine casing in order to hold the combustion chamber in position, the inner flange being provided with a plurality of holes for feeding cooling air to a high pressure turbine of the turbomachine, the air feed holes through the inner flange being distributed circumferentially over at least two rows disposed in a staggered configuration.

4 Claims, 2 Drawing Sheets

ANNULAR COMBUSTION CHAMBER FOR A TURBOMACHINE WITH AN IMPROVED INNER FASTENING FLANGE

BACKGROUND OF THE INVENTION

The present invention relates to the general field of combustion chambers for turbomachines. More particularly, it relates to the problem posed by fastening an annular combustion chamber for a turbomachine to the casing of the turbomachine.

Conventionally, the annular combustion chamber of a turbomachine is made up of inner and outer annular walls interconnected by a transverse wall forming the end of the chamber. The end of the chamber is provided with a plurality of openings having fuel injectors mounted therein.

At their downstream ends, the inner and outer walls of the combustion chamber are generally extended by likewise annular inner and outer flanges that are designed to be fastened respectively to the inner and outer shells of the turbomachine casing. These flanges serve to hold the combustion chamber in position inside the turbomachine casing.

Air coming from a compressor stage of the turbomachine located upstream from the combustion chamber flows between the shells of the casing and the annular walls of the chamber. This air which penetrates into the chamber in particular via holes formed through the walls of the chamber participate in the combustion of the air/fuel mixture.

Furthermore, a fraction of this air serves to feed a circuit for cooling the high pressure turbine of the turbomachine that is disposed downstream from the combustion chamber.

For this purpose, the inner fastening flange of the combustion chamber is typically pierced by a plurality of holes that allow air to pass from the compressor to a cooling circuit of the high pressure turbine. These holes are generally uniformly spaced apart along a row over the entire circumference of the inner flange.

The inner shell of the casing of the turbomachine is also pierced by a plurality of orifices that open out into the annular space defined between the inner shell and the inner flange for fastening the chamber, and that also open out towards the cooling circuit of the high pressure turbine.

Drilling air feed holes through the inner flange for fastening the combustion chamber raises problems of its ability to withstand the vibration generated by combustion of the air/fuel mixture in the chamber.

The combustion frequencies of the air/fuel mixture in the chamber cause vibration in the chamber walls which propagates to the fastener flanges. The fastener flanges must therefore be sufficiently flexible to damp such vibration, but also sufficiently rigid to perform their function of holding the combustion chamber in position in the casing.

Unfortunately, the presence of holes through the inner fastener flange weakens the ability of the flange to withstand vibration. Vibration in the walls of the chamber, associated with a regular distribution of the holes in the inner flange, leads to a vibratory resonance phenomenon that leads to a risk of the inner flange breaking, in particular between two adjacent holes.

OBJECT AND SUMMARY OF THE INVENTION

The present invention thus seeks to mitigate such drawbacks by proposing a combustion chamber which is better at withstanding the vibration generated by the combustion of the air/fuel mixture.

To this end, the invention provides an annular combustion chamber for a turbomachine, the chamber comprising inner and outer annular walls united by a transverse wall, the inner and outer walls being extended at their downstream ends by inner and outer fastener flanges for being fastened respectively to inner and outer shells of a casing of the turbomachine in order to hold the combustion chamber in position, the inner flange being provided with a plurality of holes for feeding cooling air to a high pressure turbine of the turbomachine, wherein the air feed holes through the inner flange are distributed circumferentially over at least two rows disposed in a staggered configuration.

The particular distribution of the holes through the inner flange over at least two rows disposed in a staggered configuration has the effect of "breaking" the harmonics of the vibration generated by the combustion of the air/fuel mixture. This distribution thus serves to avoid any vibratory resonance, and thus to limit the risk of breaking the inner flange for fastening the chamber.

According to an advantageous characteristic of the invention, the inner and outer walls are provided with a plurality of holes for feeding the chamber with air, wherein the air feed holes through the inner flange are radially offset relative to the air feed holes through the inner wall.

The radial offset between the holes through the inner flange and the holes through the inner wall of the combustion chamber thus serves to avoid the combustion gas radiating directly towards the inner shell of the casing, which radiation is particularly harmful to the lifetime of the shell.

According to another advantageous characteristic of the invention, the inner shell of the turbomachine casing is provided with a plurality of orifices, wherein the air feed holes through the inner flange are radially offset relative to the orifices through the inner shell of the casing.

For the same reason as above, this radial offset serves to avoid the combustion gas radiating directly from the chamber towards the cooling circuit of the high pressure turbine.

The present invention also provides an inner flange for holding a combustion chamber in position and as defined above.

BRIEF DESCRIPTION OF THE DRAWINGS

Other characteristics and advantages of the present invention appear from the following description made with reference to the accompanying drawings which show an embodiment that has no limiting character. In the figures.

DETAILED DESCRIPTION OF AN EMBODIMENT

Figure 1:
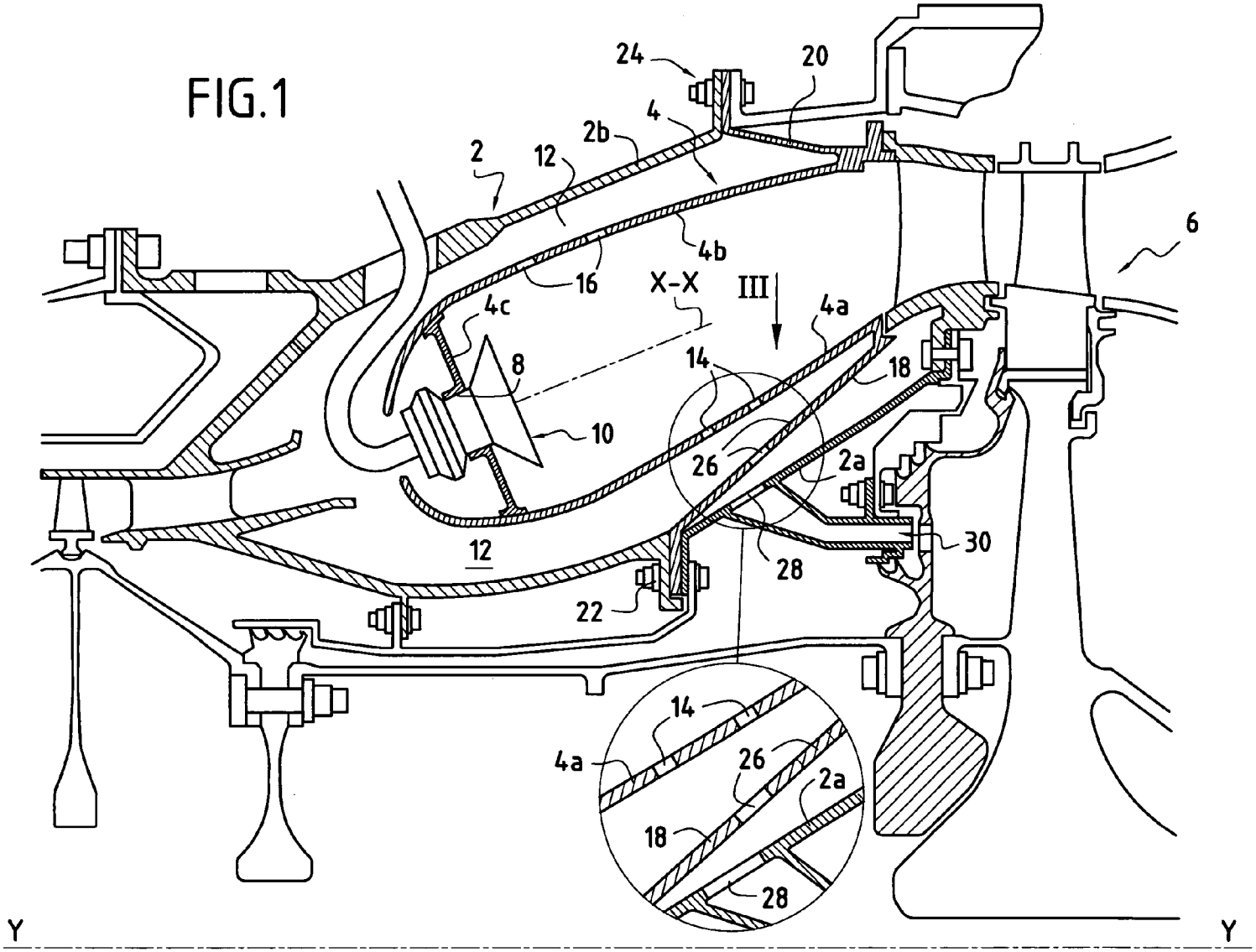
FIG. 1 is a longitudinal section view of a combustion chamber in its environment in an embodiment of the invention.

FIG. 1 shows a turbomachine combustion chamber in accordance with the invention.

The turbomachine comprises a compression section (not shown) in which air is compressed prior to being injected into a chamber casing 2 and then into a combustion chamber 4 mounted inside the casing.

The compressed air is introduced into the combustion chamber and is mixed with fuel prior to being burnt therein.

The gas that results from this combustion is then directed towards a high pressure turbine 6 disposed at the outlet from the combustion chamber 4.

The combustion chamber 4 is of the annular type and is constituted by an inner annular wall 4*a* and an outer annular wall 4*b* that are united by a transverse wall 4*c* forming the end of the chamber.

The inner and outer walls 4*a* and 4*b* extend along a longitudinal axis X-X that is slightly inclined relative to the longitudinal axis Y-Y of the turbomachine. The end 4*c* of the chamber is provided with a plurality of openings 8 in which fuel injectors 10 are mounted.

The chamber casing 2 is formed with an inner shell 2*a* and an outer shell 2*b*, and co-operates with the combustion chamber 4 to define an annular space 12 into which the compressed air is injected for combustion, for dilution, and for cooling the chamber. The chamber 4 is subdivided into a primary zone (or combustion zone) and a secondary zone (or dilution zone) situated downstream from the primary zone.

The air fed to the primary and secondary zones of the combustion chamber 4 is introduced via one or more rows of holes 14, 16 formed respectively through the inner wall 4*a* and the outer wall 4*b* of the chamber.

The inner and outer walls 4*a* and 4*b* of the chamber 4 are extended at their downstream ends by respective inner and outer annular flanges (or tongues) 18 and 20.

These inner and outer flanges 18 and 20 are designed to be fastened respectively to the inner and outer shells 2*a* and 2*b* of the chamber casing 2 via respective bolted connections 22, 24. Their function is to hold the combustion chamber 4 in position inside the chamber casing 2.

The compressed air flowing in the annular space 12 is also used for feeding a circuit for cooling the high pressure turbine 6 of the turbomachine.

For this purpose, the inner flange 18 for holding the combustion chamber 4 is provided with air feed holes 26. These holes 26 allow air to flow in the annular space 12 downstream from the inner flange 18.

Similarly, the inner shell 2*a* of the chamber casing 2 is pierced by air feed orifices 28, e.g. distributed in a single row, and opening out into the annular space 12 downstream from the inner flange 18 and leading outside the chamber casing 2 to an air injector 30. This air injector 30 is for cooling the high pressure turbine 6 of the turbomachine.

According to the invention, the air feed holes 26 of the inner flange 18 are distributed circumferentially over at least two rows 26*a* and 26*b* that are disposed in a staggered configuration.

Figure 2:
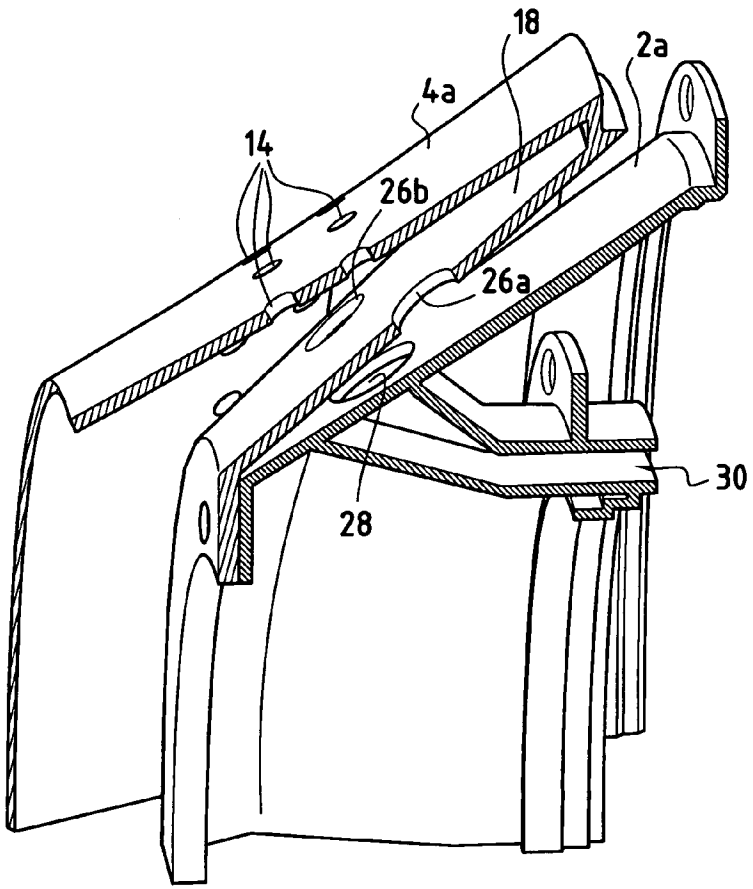
FIG. 2 is a fragmentary and cutaway perspective view of FIG. 1.
Figure 3:
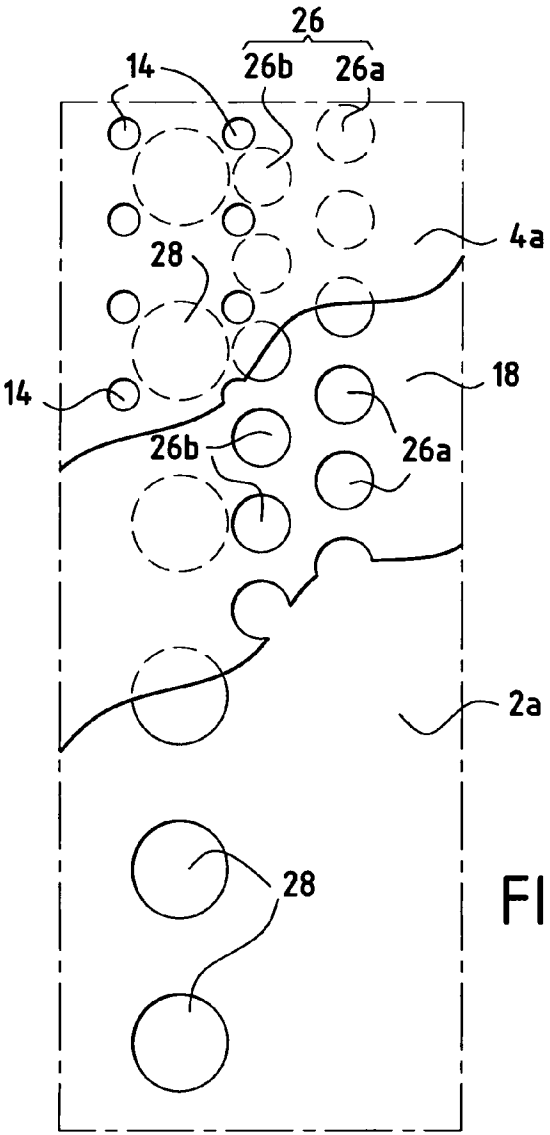
FIG. 3 is a developed view showing the distribution of the holes through the inner flange of the combustion chamber of the invention.

This distribution is shown in particular in FIGS. 2 and 3. In these figures, the two rows 26*a* and 26*b* of air feed holes through the inner flange 18 can clearly be seen to be in a staggered configuration.

The term "rows disposed in a staggered configuration" is used to mean that the holes in one of the rows 26*a*, 26*b* are not in alignment with the holes in the other row along the longitudinal axis X-X of the combustion chamber 4.

Such a disposition of the holes in two rows disposed in a staggered configuration serve to "break" the harmonics of the vibration generated by the combustion of the air/fuel mixture in the chamber, thus avoiding the inner flange from breaking under the effect of the vibration.

In FIGS. 2 and 3, the air feed holes 26 of the combustion chamber are circular in section. Nevertheless, it is possible to envisage sections of some other shape, e.g. an oblong shape.

It should also be observed that since the holes 26 through the inner flange 18 are distributed in two staggered rows, the individual sections of the holes can be smaller than in a conventional disposition in a single row while still maintaining the same general air flow rate feeding the air injector 30. Thus, the distance between two adjacent holes is increased, thereby further reducing the risk of the inner flange possibly breaking at this location.

According to an advantageous characteristic of the invention, shown in FIG. 3, the air feed holes 26 through the inner flange 18 are radially offset relative to the air feed holes 14 through the inner wall 4*a* of the combustion chamber 4.

Since the holes 26 through the inner flange 18 are not in alignment with the holes 14 through the inner wall 4*a*, it is possible to avoid the gas produced by the combustion of the air/fuel mixture in the chamber 4 radiating directly towards the inner shell 2*a* of the chamber casing 2, which would run the risk of damaging it.

According to another advantageous characteristic of the invention, also shown in FIG. 3, the air feed holes 26 through the inner flange 18 are radially offset relative to the orifices 28 through the inner shell 2*a* of the chamber casing 2.

It is thus also possible to avoid the combustion gas radiating directly from the combustion chamber 4 to the air injector 30 that is provided for cooling the high pressure turbine 6. As a result, the effectiveness with which the high pressure turbine is cooled is not degraded by the presence of the air feed holes 26 through the inner flange 18.

It should be observed that this offset between the air feed holes 26 through the inner flange 18 and the orifices 28 through the inner shell 2*a* can be combined with the advantageous offset between the same holes 26 through the inner flange and the holes 14 through the inner wall 4*a* of the combustion chamber 4.

What is claimed is:

1. An annular combustion chamber for a turbomachine, the chamber comprising inner and outer annular walls united by a transverse wall, the inner and outer walls being extended at their downstream ends by inner and outer fastener flanges for being fastened respectively to inner and outer shells of a casing of the turbomachine in order to hold the combustion chamber in position, the inner flange being provided with a plurality of holes for feeding cooling air to a high pressure turbine of the turbomachine, wherein the air feed holes through the inner flange are distributed circumferentially over at least two rows disposed in a staggered configuration.

2. A combustion chamber according to claim 1, in which the inner and outer walls are provided with a plurality of holes for feeding the chamber with air, wherein the air feed holes through the inner flange are radially offset relative to the air feed holes through the inner wall.

3. A combustion chamber according to claim 1, in which the inner shell of the turbomachine casing is provided with a plurality of orifices, wherein the air feed holes through the inner flange are radially offset relative to the orifices through the inner shell of the casing.

4. An inner flange for holding a turbomachine combustion chamber in position, wherein said combustion chamber comprises inner and outer annular walls united by a transverse wall, the inner and outer walls being extended at their downstream ends by said inner flange and by an outer flange, wherein said inner flange is configured to fasten to an inner shell of a casing of the turbomachine in order to hold the combustion chamber in position, the inner flange being provided with a plurality of holes for feeding cooling air to a high pressure turbine of the turbomachine, wherein the air feed holes through the inner flange are distributed circumferentially over at least two rows disposed in a staggered configuration.

* * * * *